US005772543A

United States Patent [19]

Paino

[11] Patent Number: 5,772,543

[45] Date of Patent: Jun. 30, 1998

[54] GAME BALL

[76] Inventor: Robert Paino, 469 Highland Ave., Malden, Mass. 02148

[21] Appl. No.: 780,316

[22] Filed: Jan. 8, 1997

Related U.S. Application Data

[63] Continuation-in-part of Ser. No. 518,663, Aug. 24, 1995, Pat. No. 5,611,541.

[51] Int. Cl.[6] ..... A63B 43/04; A63B 37/08

[52] U.S. Cl. ..... 473/594; 273/DIG. 30; 273/573

[58] Field of Search ..... 473/594, 573; 273/DIG. 30

[56] References Cited

U.S. PATENT DOCUMENTS

| | | | |
|---|---|---|---|
| 3,924,856 | 12/1975 | Dekan | 473/594 |
| 4,011,611 | 3/1977 | Lederman | 473/594 X |
| 4,834,382 | 5/1989 | Spector | 273/DIG. 30 |
| 5,611,541 | 3/1997 | Paino | 273/DIG. 30 |

*Primary Examiner*—George J. Marlo
*Attorney, Agent, or Firm*—Scott B. Garrison; Lambert & Garrison PLLC

[57] ABSTRACT

A game ball of the type adapted to be brought to a game site and filled with granular or particular material obtained at the game site comprising:

a first pliable panel having two ends, a first side, a second side, an inner and outer surface, and a flap having a length approximately one third the length of the first side protruding radially outward from a central position on the first side;

a second pliable panel substantially identical to the first pliable panel but further having the flap thereof folded over upon the inner surface thereof and permanently affixed thereto thereby forming a flap retaining element in substantial mating alignment with the flap of the first panel;

at least one third pliable panel having two ends, two sides, and an inner and outer surface;

wherein the second side of the first and second pliable panels are each permanently adjoined to one side of the third pliable panel; and a sealing device forming a temporary, user resealable connection between the flap and flap retaining element comprising a hook and loop type fastener;

wherein the game ball is first filled with said granular or particular material and once the game ball is filled to a desired volume, engaging the hook and loop type fastener seals the material within the game ball making the game ball suitable for play.

2 Claims, 2 Drawing Sheets

GAME BALL

CROSS REFERENCE TO RELATED APPLICATIONS

This application claims the benefit in the form of a continuation-in-part under 37 CFR 1.53(b)(1) of parent application Ser. No. 08/518,663 filed Aug. 24, 1995, now Pat. No. 5,611,541, by the same inventor.

BACKGROUND OF THE INVENTION

The present invention relates to the field of sporting goods. More particularly, it relates to a new design of game ball designed to be collapsed when not in use. Game balls are constructed in numerous embodiments. For instance bocci balls, billiard balls, croquet balls, and others are constructed of hard rigid materials such as wood or plastic composites. Whereas footballs, basket balls, and soccer balls are constructed of a flexible plastic or rubber designed to retain air under pressure. Other examples of game balls include golf balls which range from having slightly compressible to predominantly rigid interiors, however all are enveloped by a hard, rigid exterior. Baseballs and softballs have an interior somewhat similar to that of golf balls but are wrapped in leather or a leather substitute. Other constructions of game balls certainly exist, but none have the properties sought by the Applicant herein.

The Applicant seeks to develop a game ball which is easily transported, occupying a minimal amount of space, yet not limited in its size. In other words a small ball such as a golf ball meets these requirements but a golf ball is unsuitable for many games in which a larger game ball is required. Although an inflatable ball possesses the characteristics of being easily transported, this is typically true only if it is deflated during transport. The Applicant considers inflatable balls to be limited in their capabilities. Commonly, inflatable balls possess properties causing them to undergo elastic collisions or semi-elastic collisions with other objects. The Applicant has no desire to create a game ball that possesses the degree of elastic properties exhibited by most inflatable balls, furthermore, the Applicant seeks to develop a game ball that has more mass than would a ball inflated with a gas.

As such what is needed is a ball that can be easily transported without requiring a great deal of space. This game ball would also be capable of being thrown, tossed or rolled and would exhibit minimal tendencies toward elastic collision. However, the ball should possess sufficient mass to be useful in games such as bocci in which it is desirous to displace another ball from a first to a second position. In essence, the ball should be capable of transferring sufficient kinetic energy to an object hit such that the ball does not elastically collide with the impacted object yet the kinetic energy transferred to the impacted object should be sufficient to move the object.

SUMMARY OF THE INVENTION

As such, the Applicant has created a game ball exhibiting these features. This game ball is collapsible when stored. But in its non-collapsed embodiment, it is of sufficient mass that when propelled by a user, it possesses enough kinetic energy to effect another similar game ball if hit. The Applicant has created this game ball by providing a hollow, collapsible game ball possessing a cavity designed to be filled with sand, or some other granular substance. Additionally, the game ball can be made liquid or water tight so it can be filled with a liquid if desired. Nevertheless, the game ball is designed to enable it to be emptied when not in use and to be filled with materials found at the location of play. In essence, the game ball can be brought to the play area empty, filled with sand, gravel, pebbles, beans, etc., and used in play. When play is over, the material can be emptied and disposed of properly. In the event the user desires to keep the ball filled for whatever reason, this too is possible.

Applicant has envisioned such a game ball to be useful for travelers or hikers. Such people are often under either weight constraints or space constraints. With the Applicant's ball, a traveler, hiker or other person having a similar restriction can pack a ball or even a plurality of such balls in his or her travel items for use at the destination point. For instance, travelers going to beach resorts, can bring these balls along and fill them at the beach for use in a number of games. Hiker's on the Appalachian Trail can carry these balls for entertainment after a day's hike. The uses are endless.

One such game that use of Applicant's balls are envisioned is the game of bocci. However, unlike traditional bocci, which must be played on a relatively hard packed surface such as grass, clay, or other packed soils, the game ball described in the present invention can be used to play bocci on other surfaces such as sand or loose gravel. Additionally such a game ball is useful for play on hard rigid surfaces such as rock ledge, concrete, or pavement where the user does not desire the ball to roll great distances as would occur if a rigid ball were rolled along a rigid surface.

Due to the game ball being filled with a granular or fluid material, it is capable of being filled to the user's preference. For instance, if the user were intent upon playing a game on a paved or concrete surface, the user would not entirely fill the ball with material. This would enable the ball to exhibit tendencies toward more plastic deformation as the ball rolls or otherwise contacts the surface upon which the game is played. This is because the particles of material within the cavity are given ample room to shift with respect to each other, thereby generating friction. As such, this plastic deformation serves to slow and eventually stop the ball as it rolls upon such a hard surface. Alternatively, in the event the user were playing on a loose granular surface, the game ball could be filled completely with material. This not only reduces the plastic deformation of the game ball with respect to the surface upon which it is rolled since it is more difficult for the material to shift within the game ball cavity; but it also increases the kinetic energy of the ball due to the mass of the additional material. The corresponding increase in kinetic energy for any given quantity of velocity enables the ball to roll further.

However, due to the construction of the game ball, it will always undergo some plastic deformation as it rolls along a surface. This has been found to be an advantage, because unlike rigid balls or gas filled balls, the game ball of the present invention has been found to dampen a great deal of the irregularities found in the surface. This dampening effect serves to minimize the effect that a foreign object may have in diverting the game ball from its course. Additionally, this characteristic toward at least some plastic deformation allows a unique ability for this ball not exhibited by any other ball of which applicant is aware. That property being the capability of one ball to land on and stay on top of another ball.

A game ball of the present construction should be constructed of at least one and preferably a plurality of non-rigid, collapsible panels, each interconnected one to the other to form a ball-like object. The non-rigid collapsible panels would envelop a cavity capable of receiving and retaining a granular substance. The panels and interconnection of the same can easily be made liquid tight to hold water or the like. Some manner of access must exist to enable the user to fill the game ball with material. Additionally, this access must also enable the user to seal the material within the cavity once the game ball is filled.

Accordingly, it is an object of the present invention to provide a game ball comprising at least one panel of flexible material wherein the panel is connected to itself in such a manner so as to form a soft, crushable shell, wherein the shell surrounds a cavity capable of being filled with a granular or liquid material.

It is another object of the present invention to provide a game ball which can be filled with various types of material via a resealable opening.

It is yet another object of the present invention to create a collapsible game ball which can be brought to the desired location of play and be filled by material found at such location just prior to play.

It is still a further object to provide a game ball which in its collapsed state requires minimal space thereby being, useful to travelers with space or weight constraints.

Another object of the present invention is to provide a game ball capable of sufficient plastic deformation to enable it to land and remain atop of an object such as another game ball.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of a specific preferred embodiment when read and understood in connection with the accompanying drawings.

DETAILED DESCRIPTION OF THE PREFERRED EMBODIMENT

Figure 5:
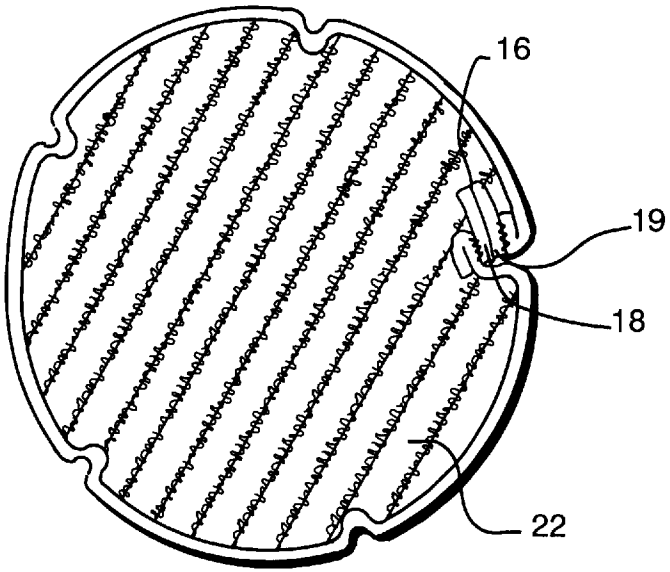
FIG. 5 is a cross-sectional view of the FIG. 1 game ball taken through line A—A.
Figure 1:
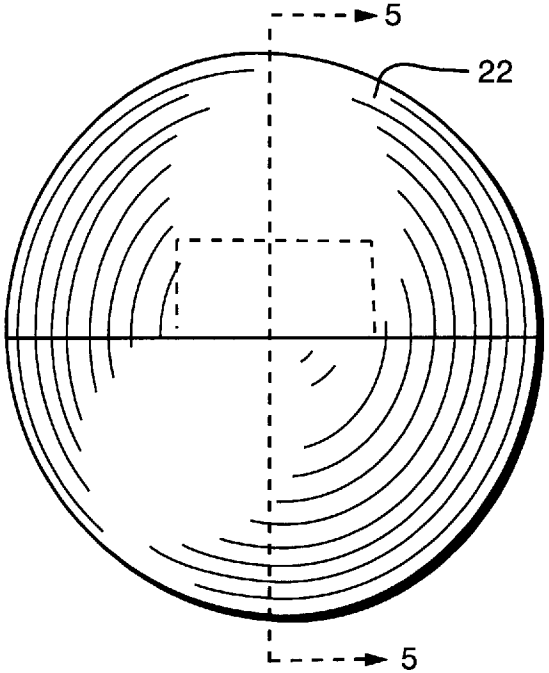
FIG. 1 is a three dimensional view of a game ball of the present invention.
Figure 4:
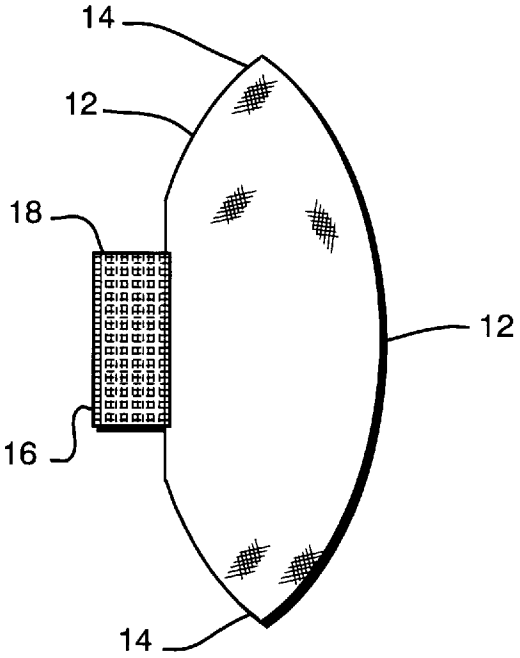
FIG. 4 is a plan view of a third panel of such material having the other, mating half of said sealing means.
Figure 3:
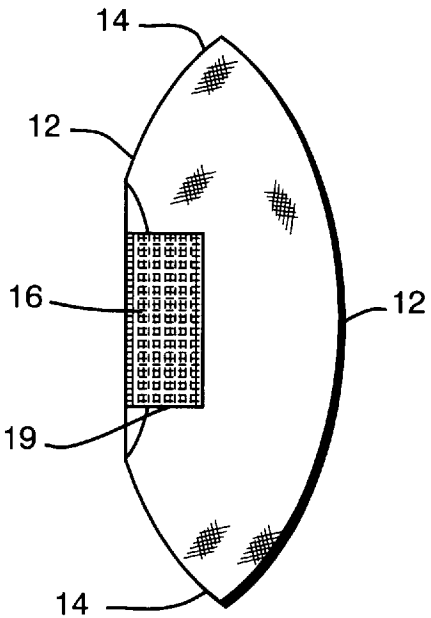
FIG. 3 is a plan view of a second panel of such material having one half of a sealing means to seal said game ball.
Figure 2:
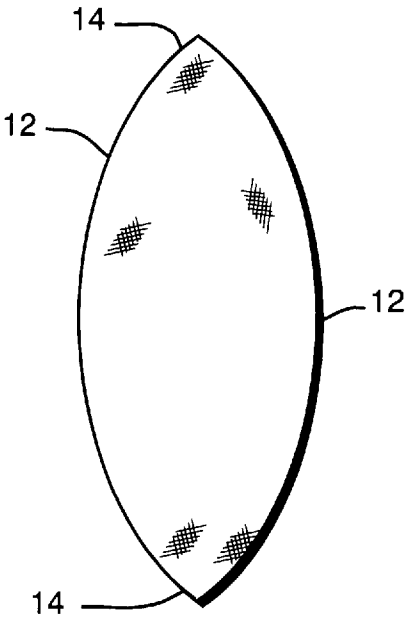
FIG. 2 is a plan view of a first panel of material preferred to make up the game ball comprising the present invention.

FIG. 1 depicts a preferred embodiment of a new game ball in accordance with the present invention. FIG. 5 depicts the ball with three panels for clarity in explanation, however, five total panels are preferred by Applicant. FIGS. 2, 3, and 4 form individual parts of FIG. 1. Additionally FIGS. 2, 3, and 4 can be made in exactly the same manner and from the same materials. The only difference of significance between these panels is that FIGS, 3 and 4, each contain a portion of a sealing means, intended to mate one with the other. The materials contemplated by the applicant for each panel should be soft materials such as natural or imitation leathers, rubber, plastic, or textile products; including cloth, canvas, and other natural and man-made fabrics.

Now more particularly, FIGS. 2, 3, and 4 each have two ends, 14 and two side portions, 12. The FIG. 1 game ball is formed by joining a plurality of FIG. 2 panels with one FIG. 3, and one FIG. 4 panel. The FIG. 3 panel should border one side of the plurality of FIG. 2 panels, whereas the FIG. 4 panel should border the other side of the plurality of FIG. 2 panels. The FIG. 3 and FIG. 4 panels should be arranged so that each portion of the sealing means engage, one with the other. When all panels are joined along sides 12 and both ends 14 are also joined with ends 14 of other panels, it will be found that an object is defined which encloses a cavity 22. One embodiment of such joined panels would form a globe-like object. Applicant considers the invention to be more practical for all edges to be stitched, folded over or by some other means known in the art, prevented from fraying. Although the Applicant has found that three of the FIG. 2 panels is sufficient to make a practical game ball, hence the explanation from this perspective, the number of panels is actually irrelevant to the concept of the invention. In fact, Applicant has an alternative embodiment which envisions the elimination of the plurality of panels. In this alternate embodiment, the game ball would essentially be formed from a container having an opening for receiving a filling, and a sealing means to retain such filling. This alternate embodiment would best be adapted for liquid tight applications, as there are fewer seams. For ease of continued explanation, Applicant refers to the first embodiment disclosed, unless specifically stated otherwise, with the understanding that the explanation is also applicable to the alternate embodiment.

A satisfactory means of joining all panels together would be by stitching, as is commonly done in the game ball industry. However, other joining means could also be accommodated such as glued seams, etc. The sealing means selected must be capable of retaining a filler material added to cavity 22 when a user desires to fill the game ball. As such, the sealing means is dependent upon the material used to fill the game ball. For instance, in the event that the game ball were to be filled by a liquid, the sealing means should comprise an interlocked plastic seam or other liquid tight sealing means. Zippers, tied laces, snaps, buttons or many other methods could be used to retain various sized particles comprising the material. Other than the requirement that the sealing means be capable of retaining the material placed within cavity 22, market considerations will guide the actual selection of sealing means. Currently, Applicant has created a preferred sealing means, best depicted in FIGS. 3, 4, and 5. Said preferred sealing means comprises a flap 18 extending from one side 12 of the FIG. 4 panel. Upon said flap is one-half of a securing means comprising a hook and loop type fastener 16, e.g., the hook element of such a fastener. Flap 18 is configured in such a manner as to be received by a flap receiving element 19 depicted on FIG. 3. Said flap receiving element is configured in such a manner so as to align with flap 18 and includes the other half of said securing, means comprising the loop element of hook and loop type fastener 16. In the preferred embodiment flap receiving element 19 depicted in FIG. 3 faces inward toward cavity 22 while flap 18 faces outward.

Use of a game ball of the present device can be had by filling the game ball with sand, or other material. Once filled to the desired amount, the user simply secures the sealing means. In the case of a hook and loop type fastener, the applicant presses the fastener together and the material will remain within the cavity until the cavity is emptied manually. The reason for the material remaining within the cavity and not simply pouring out is due to the unique construction of the sealing means. As stated, flap 18 extends outward from the FIG. 4 panel and tucks under and secures to flap receiving element 19. This arrangement results in any force created by the material within cavity 22 being directed toward both flap 18 and flap receiving element 19 at an angle perpendicular to the sealing means which helps to keep the sealing means in place.

While the invention has been described and illustrated with reference to a specific embodiment thereof, it is understood that other embodiments may be resorted to without departing from the invention. Therefore the form of the invention set out above should be considered illustrative and not as limiting the scope of the following claims.

I claim:

1. A game ball of the type adapted to be brought to a game site and filled with granular or particulate material obtained at the game site comprising:

a first pliable panel having two ends, a first side, a second side, an inner and outer surface, and a flap having a length approximately one third the length of said first side protruding radially outward from a central position on said first side;

a second pliable panel substantially identical to said first pliable panel but further having the flap thereof folded over upon the inner surface thereof and permanently affixed thereto thereby forming a flap retaining element in substantial mating alignment with said flap of said first panel;

at least one third pliable panel having two ends, two sides, and an inner and outer surface;

wherein the second side of said first and second pliable panels are each permanently adjoined to one side of said third pliable panel; and a sealing means forming a temporary, user resealable joining means between said flap and said flap retaining means, comprising a hook and loop type fastener;

wherein said game ball is first filled with said granular or particulate material and once the game ball is filled to a desired volume, engaging the hook and loop type fastener seals the material within the game ball making said game ball suitable for play desired volume of said material is sealing said disposed upon said outer surface.

2. A game ball as claimed in claim 1 wherein there are three of said third pliable panels.

* * * * *

UNITED STATES PATENT AND TRADEMARK OFFICE

CERTIFICATE OF CORRECTION

PATENT NO. : 5,772,543
DATED : Jun. 30, 1998
INVENTOR(S) : Robert Paino

It is certified that error appears in the above-identified patent and that said Letters Patent is hereby corrected as shown below:

Column 6,
Lines 17 to 19, cancel the text beginning with the comma ", desired volume of said material is sealing said disposed upon said outer surface" and ending just prior to the period.

Signed and Sealed this

Tenth Day of August, 2004

JON W. DUDAS
*Acting Director of the United States Patent and Trademark Office*